US011763612B2

(12) United States Patent
Jun

(10) Patent No.: US 11,763,612 B2
(45) Date of Patent: Sep. 19, 2023

(54) VEHICLE AND CONTROL METHOD THEREOF

(71) Applicants: HYUNDAI MOTOR COMPANY, Seoul (KR); KIA CORPORATION, Seoul (KR)

(72) Inventor: Sung Hwan Jun, Hwaseong-si (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 0 days.

(21) Appl. No.: 17/752,227

(22) Filed: May 24, 2022

(65) Prior Publication Data

US 2022/0392284 A1 Dec. 8, 2022

(30) Foreign Application Priority Data

Jun. 2, 2021 (KR) ..... 10-2021-0071580

(51) Int. Cl.
*G07C 9/00* (2020.01)
*G07C 5/00* (2006.01)

(52) U.S. Cl.
CPC ..... *G07C 9/00309* (2013.01); *G07C 5/008* (2013.01); *G07C 2009/00769* (2013.01)

(58) Field of Classification Search
None
See application file for complete search history.

(56) References Cited

U.S. PATENT DOCUMENTS 8,682,525 B1 * 3/2014 Kalinadhabhotla ..... G06F 7/00 340/442
8,954,230 B2 * 2/2015 Kalinadhabhotla .... G07C 5/008 340/442
2014/0172190 A1 * 6/2014 Kalinadhabhotla ..... G06F 7/00 701/1

* cited by examiner

*Primary Examiner* — Carlos Garcia
(74) *Attorney, Agent, or Firm* — MCDONNELL BOEHNEN HULBERT & BERGHOFF LLP

(57) ABSTRACT

A vehicle includes a plurality of controllers, a database in which priorities for switching to inactivation of the plurality of controllers are stored, and a main controller configured to identify whether a key of the vehicle is in off state, when the key of the vehicle is identified to be in off state, identify a communication state of the vehicle, when at least one communication state is identified among a first communication state, a second communication state, and a third communication state, select a controller corresponding to the identified communication state from the plurality of controllers, based on the identified communication state and the priorities stored in the database, the first communication state in which an active sate of communication being maintained due to a controller in error, the second communication state in which the active sate and an inactive state of communication being repeated due to the controller in error, the third communication state in which the active sate of communication being maintained due to a noise signal, and reset or cut off a power of the controller.

20 Claims, 7 Drawing Sheets

FIG. 3

| Source DOMAIN | Source CONTROLLER | Source SIGNAL | Destination DOMAIN | Destination SIGNAL |
|---|---|---|---|---|
| MCAN | H_U | HU_A | CCAN | HU_A |
| BCAN | IBU | IBU_A | MCAN | IBU_A |

111

112

VEHICLE AND CONTROL METHOD THEREOF

CROSS REFERENCE TO RELATED APPLICATIONS

This application is based on and claims priority under 35 U.S.C. § 119 to Korean Patent Application No. 10-2021-0071580, filed on Jun. 2, 2021 in the Korean Intellectual Property Office, the disclosure of which is incorporated herein by reference.

BACKGROUND

1. Field

The disclosure relates to a vehicle and a control method thereof.

2. Description of the Related Art

Recently, the total current consumption of a vehicle significantly increased due to the increase in the number of controllers in the vehicle and the increased network complexity, causing a discharge of the vehicle. One of the main reasons of vehicle discharge is that a communication state of a controller is continuously maintained in an active state or is not inactivated even when the controller is required to enter an inactive state.

In particular, when Ethernet communication is applied, an active state of communication of a controller is maintained and an in-vehicle network is continuously activated, resulting in the consumption of a current of approximately 5 A to 10 A. Such unnecessary current consumption affects a vehicle's battery, causing frequent discharge.

Meanwhile, in an existing load shedding technology, when a certain period of time elapses after the inactivation of a communication of a controller, the power of a designated controller is simply cut off stepwise or the load is forcibly cut off stepwise, based on a state of charge of a battery.

SUMMARY

An aspect of the disclosure provides a vehicle that may cut off a load of a controller more accurately by identifying a communication state of the controller accurately and classifying errors of the controller into three types.

Additional aspects of the disclosure will be set forth in part in the description which follows and, in part, will be obvious from the description, or may be learned by practice of the disclosure.

According to an aspect of the disclosure, there is provided a vehicle, including a plurality of controllers, a database in which priorities for switching to inactivation of the plurality of controllers are stored, and a control part configured to identify whether a key of the vehicle is in off state, when the key of the vehicle is identified to be in off state, identify a communication state of the vehicle, when at least one communication state is identified among a first communication state, a second communication state and a third communication state, select a controller corresponding to the identified communication state from the plurality of controllers, based on the identified communication state and the priorities stored in the database, the first communication state in which an active sate of communication being maintained due to a controller in error, the second communication state in which the active sate and an inactive state of communication being repeated due to the controller in error, the third communication state in which the active sate of communication being maintained due to an noise signal, and reset or cut off a power of the controller.

When the first communication state continues even after a first predetermined period of time after the key of the vehicle is turned off, the controller is configured to identify a controller corresponding to the first communication state, and reset a power of the identified controller.

The controller is configured to repeatedly reset the power of the controller a preset number of times, when the first communication state continues even after the power of the controller is reset.

When the first communication state continues even after a second predetermined period of time after the key of the vehicle is turned off, the controller is configured to cut off the power of the controller based on the priorities stored in the database.

When the communication state is identified as the second communication state, the controller is configured to identify a controller corresponding to the second communication state and reset a power of the controller based on a network management (NM) message.

When the second communication state continues even after a third predetermined period of time after the key of the vehicle is turned off, the controller is configured to identify a controller that is changed first from the inactive state to the active state, among the plurality of controllers based on the NM message, and cut off a power of the identified controller.

The controller is configured to cut off an entire power of the plurality of controllers, when the communication state is identified as the third communication state.

The controller is configured to store information about at least one of a power reset history or a power cut-off history of the plurality of controllers in the database, and transmit the stored information to a cloud center.

The vehicle further including: an antenna; and a remote keyless entry (RKE) module including an RKE controller.

When a door opening and closing signal using RKE is received from a user, the controller is configured to switch a relay of the antenna to automatically open and close a door.

The controller is configured to periodically update the RKE controller based on an update of the RKE controller.

According to another aspect of the disclosure, there is provided a control method of a vehicle, the control method including identifying whether a key of the vehicle is in off state, when the key of the vehicle is identified to be in off state, identifying a communication state of the vehicle, when at least one communication state is identified among a first communication state, a second communication state and a third communication state, selecting a controller corresponding to the identified communication state, based on the identified communication state and priorities stored in a database, the first communication state in which an active sate of communication being maintained due to a controller in error, the second communication state in which the active sate and an inactive state of communication being repeated due to the controller in error, the third communication state in which the active sate of communication being maintained due to an noise signal, and resetting or cutting off a power of the controller.

The control method further includes, when the first communication state continues even after a first predetermined period of time after the key of the vehicle is turned off, identifying a controller corresponding to the first communication state, and resetting a power of the identified controller.

The control method further includes repeatedly resetting the power of the controller a preset number of times, when the first communication state continues even after the power of the controller is reset.

The control method further includes, when the first communication state continues even after a second predetermined period of time after the key of the vehicle is turned off, cutting off the power of the controller based on the priorities stored in the database.

The control method further includes, when the communication state is identified as the second communication state, identifying a controller corresponding to the second communication state and resetting a power of the controller based on an NM message.

The control method further includes, when the second communication state continues even after a third predetermined period of time after the key of the vehicle is turned off, identifying a controller that is changed first from the inactive state to the active state among a plurality of controllers, based on the NM message, and cutting off a power of the identified controller.

The control method further includes cutting off an entire power of a plurality of controllers, when the communication state is identified as the third communication state.

The control method further includes storing information about at least one of a power reset history or a power cut-off history of a plurality of controllers in the database, and transmitting the stored information to a cloud center.

The control method further includes, when a door opening and closing signal using RKE is received from a user, switching a relay of an antenna to automatically open and close a door.

BRIEF DESCRIPTION OF THE FIGURES

These and/or other aspects of the disclosure will become apparent and more readily appreciated from the following description of the embodiments, taken in conjunction with the accompanying drawings of which:

FIG. 3 is a diagram illustrating priority training data of a vehicle according to an embodiment;

DETAILED DESCRIPTION

Figure 1:
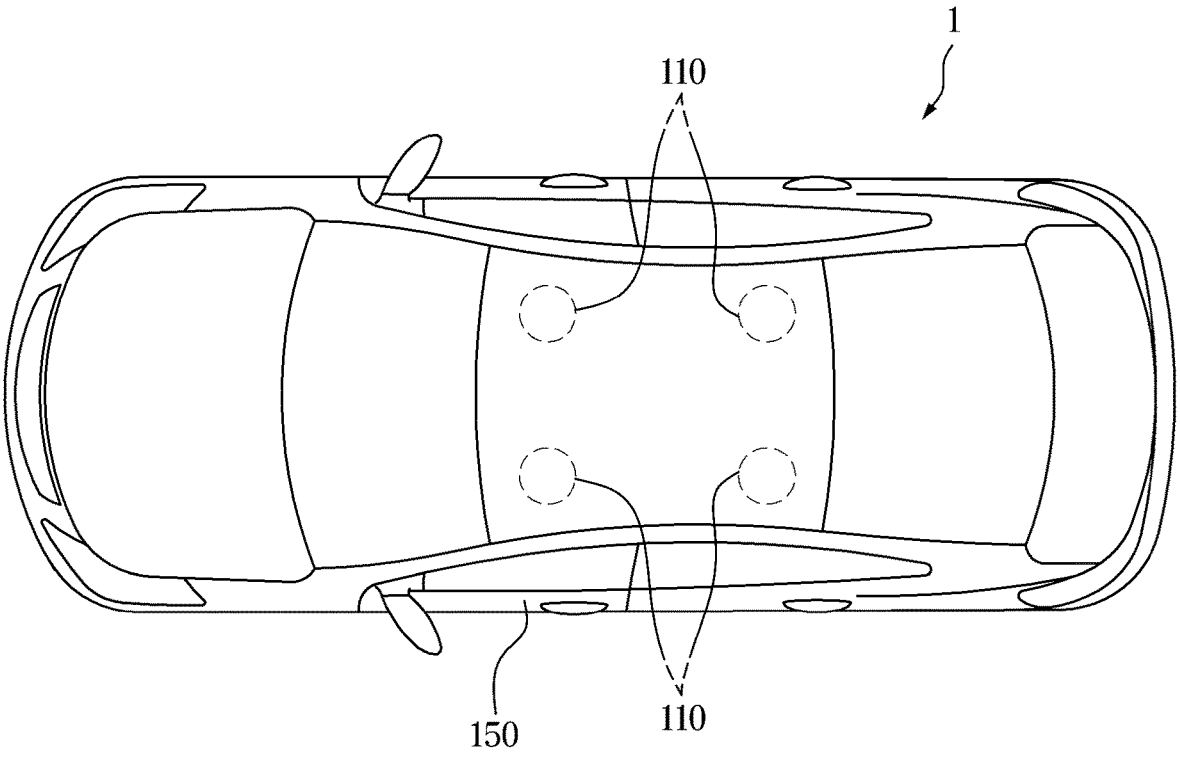
FIG. 1 is a diagram of a vehicle according to an embodiment.

Like reference numerals throughout the specification denote like elements. Also, this specification does not describe all the elements according to embodiments of the disclosure, and descriptions well-known in the art to which the disclosure pertains or overlapped portions are omitted. The terms such as "~part", "~device", "~module", and the like may refer to a unit for processing at least one function or act. For example, the terms may refer to at least process processed by at least one hardware or software. According to embodiments, a plurality of "~parts", "~devices", or "~modules" may be embodied as a single element, or a single of "~part", "~device", or "~module" may include a plurality of elements.

It will be understood that when an element is referred to as being "connected" to another element, it can be directly or indirectly connected to the other element, wherein the indirect connection includes "connection" via a wireless communication network.

It will be understood that the terms "include" when used in this specification, specify the presence of stated features, integers, steps, operations, elements, and/or components, but do not preclude the presence or addition of one or more other features, integers, steps, operations, elements, components, and/or groups thereof.

It will be understood that when it is stated in this specification that a member is located "on" another member, not only a member may be in contact with another member, but also still another member may be present between the two members.

It will be understood that, although the terms first, second, etc. may be used herein to describe various elements, these elements should not be limited by these terms.

It is to be understood that the singular forms are intended to include the plural forms as well, unless the context clearly dictates otherwise.

Reference numerals used for method steps are just used for convenience of explanation, but not to limit an order of the steps. Thus, unless the context clearly dictates otherwise, the written order may be practiced otherwise.

Hereinafter, an operation principle and embodiments will be described in detail with reference to the accompanying drawings.

As shown in FIG. 1, a vehicle 1 may include a plurality of controllers 110 and a door 150. The plurality of controllers 110 may be connected to an Ethernet switch 130 that performs communication with electronic devices provided in the vehicle 1.

Figure 2:
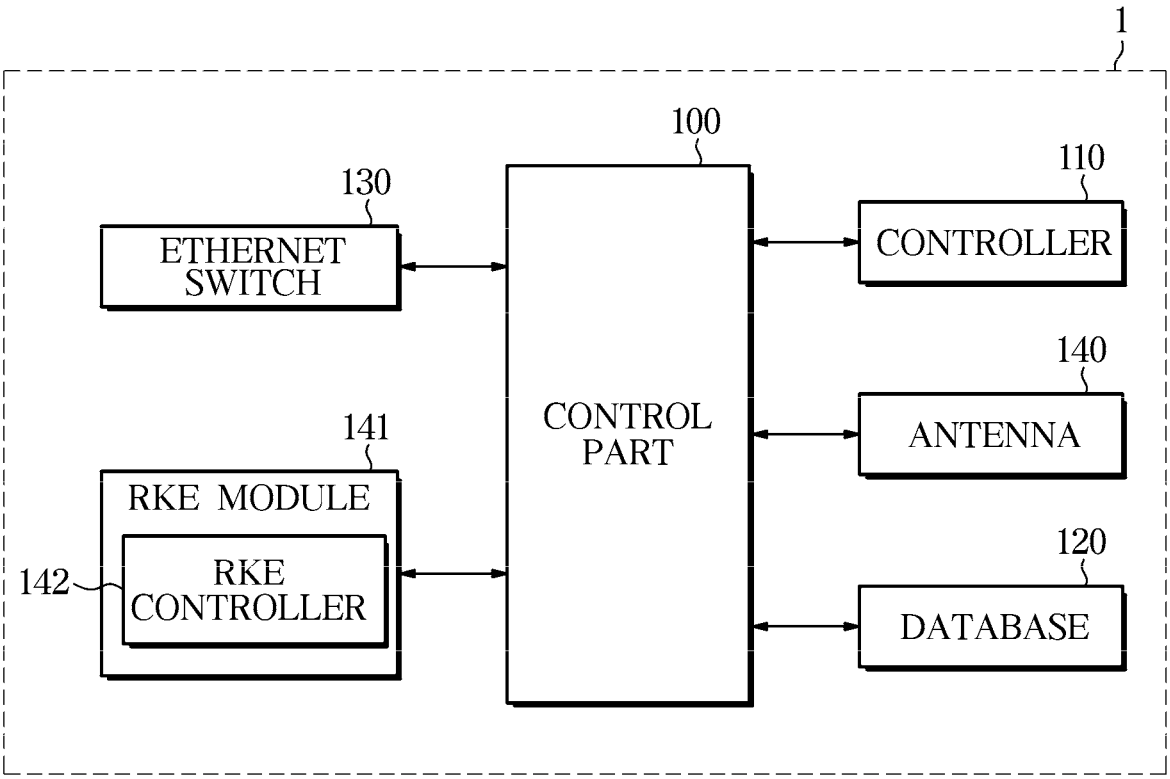
FIG. 2 is a control block diagram of a vehicle according to an embodiment.

As shown in FIG. 2, according to an embodiment, the vehicle 1 may include the plurality of controllers 110, a database 120, and a control part (100, main controller). Priorities for switching to inactivation of the plurality of controllers 110 are stored in the database 120. When at least one communication state is identified among a first communication state, a second communication state and a third communication state, the control part 100 may select a controller 110 corresponding to at least one of the first to third communication states from the plurality of controllers 110, based on the identified communication state and the priorities stored in the database 120, and may reset or cut off a power of the selected controller 110. Here, the first communication state refers to a state in which an active sate of communication is maintained due to a controller 110 in error, and the second communication state refers to a state in which the active sate and an inactive state of communication are repeated due to the controller 110 in error. Also, the third communication state refers to a state in which the active sate of communication is maintained due to a noise signal (unnecessary signal).

Also, the vehicle 1 may further include the Ethernet switch 130, an antenna 140, a remote keyless entry (RKE) module 141, and an RKE controller 142.

More specifically, the Ethernet switch 130 may be connected to the electronic devices provided in the vehicle 1 and perform Ethernet communication. The plurality of controllers 110 provided in the vehicle 1 may be connected to the Ethernet switch 130.

Here, the Ethernet communication is a network for transmitting and receiving data among the plurality of controllers 110 in the vehicle 1, e.g., a controller area network (CAN), a CAN with flexible data rate (CAN FD), Ethernet network, etc. A CAN communication method transmits data according to a priority of a message identifier (ID) allocated each controller. The Ethernet communication uses point-to-point (1:1 communication) method among controllers and enables network expansion using a switch.

The control part 100 may learn priorities for switching to inactivation of each of the plurality of controllers 110 or each domain, based on data stored in a routing data base (RDB).

The control part 100 may store information about the priorities for switching to inactivation of each of the plurality of controllers 110 in the database 120.

The control part 100 may identify whether a key of the vehicle 1 is in 'off' state.

When the key of the vehicle 1 is identified to be in 'off' state, the control part 100 may identify whether a communication state of at least one of the plurality of controllers 110 in the vehicle 1 is in an active state or an inactive state.

More specifically, when the key of the vehicle 1 is in 'off' state, the control part 100 may identify whether communication states of the plurality of controllers 110 in the vehicle 1 is in the inactive state, in order to confirm whether a use of the electronic devices mounted in the vehicle 1 is normally stopped.

The control part 100 may identify at least one communication state of the first communication state in which the active sate of communication is maintained due to the controller 110 in error, the second communication state in which the active sate and the inactive state of communication are repeated due to the controller 110 in error, and the third communication state in which the active sate of communication is maintained due to the noise signal.

When it is identified that a network in the vehicle 1 is maintained in the at least one of the first to third communication states after the key of the vehicle 1 is turned off, the control part 100 may identify a controller 110 corresponding to the at least one communication state of the first to third communication states, among the plurality of controllers 110 in the vehicle 1.

The control part 100 may confirm a reset history or a cut-off history of each of the plurality of controllers 110 to identify the controller 110 corresponding to the at least one communication state of the first to third communication states. Here, the reset history or the cut-off history of each of the plurality of controllers 110 are stored in the database 120.

When it is identified that the network in the vehicle 1 is in the first communication state even after a first predetermined period of time after the key of the vehicle 1 is turned off, the control part 100 may identify a controller 110 that maintains the first communication state for a predetermined period of time T.

In this instance, the first predetermined period of time may be an allowable time taken until a communication state of the network in the vehicle 1 is converted to the inactive state after the key is turned off.

Also, the predetermined period of time T may be a time for monitoring a communication state of the controller 110 which is in the active state, after the key is turned off.

The control part 100 may identify the controller 110 that maintains the first communication state for the predetermined period of time T, and reset a power of the controller 110 corresponding to the first communication state.

Also, the control part 100 may identify the controller 110 that maintains the first communication state for the predetermined period of time T, and repeatedly reset the power of the controller 110 corresponding to the first communication state a preset number of times.

When it is identified that the network in the vehicle 1 is still in the first communication state even after a second predetermined period of time after the power of the controller 110 is reset, the control part 100 may cut off the power of the controller 110 based on the priorities stored in the database 120.

In this instance, the second predetermined period of time may be an allowable time taken until a communication state of the controller 110 is converted to the inactive state after the controller 110 in error is reset one or more times.

For example, the control part 100 may cut off a power of a controller 110 with a highest priority for switching to inactivation, based on the priorities stored in the database 120, and also cut off a power of an upper controller 110 of a controller 110 where an error currently occurs.

Although it has been described above that the power of the controller 110 is reset or cut off based on the priorities stored and trained in the database 120 in an embodiment of the disclosure, power of all the controllers 110 which are in the active state may be reset or cut off without considering trained priority data.

When it is identified that the network in the vehicle 1 is in the second communication state, the control part 100 may identify a controller 110 corresponding to the second communication state, based on a network management (NM) message.

The control part 100 may reset a power of the controller 110 corresponding to the second communication state. More specifically, the control part 100 may identify the controller 110 which is in the active state among the plurality of controllers 110 by distinguishing activation and inactivation by referring to an inactivation attribute value of the controller 110 included in the NM message. Also, in a domain where the NM message is not applied, the controller 110 which is in the active state may be identified based on a presence or absence of a transmission/reception signal.

For instance, the control part 100 may simultaneously monitor domains that use the NM message, and identify a controller 110 in which all attributes of the NM message are changed first from the inactive state to the active state.

The control part 100 may set the controller 110 in which all the attributes of the NM message are changed first from the inactive state to the active state, as a controller 110 that is required to be converted to the inactive state with a highest priority.

When it is identified that the network in the vehicle 1 is still in the second communication state even after a third predetermined period of time after the key of the vehicle 1 is turned off, the control part 100 may identify a controller 110 in which all attributes of the NM message are changed first from the inactive state to the active state for the predetermined period of time T.

In this instance, the third predetermined period of time may be an allowable time taken until the communication state of the network in the vehicle 1 is converted to the inactive state after the key is turned off.

The control part 100 may cut off a power of the controller 110 in which an attribute is changed first from the inactive state to the active state.

Also, when the communication state of the controller 110 still maintains the inactive state even after the controller 110 is reset one time, the control part 100 may additionally perform resetting a preset number of times, and when the inactive state is still maintained, the control part 100 may cut off the power of the controller 110.

In addition, when the inactive state is still maintained after the controller 110 is reset one time, the control part 100 may cut off the power of the controller 110 immediately.

When it is identified that the network in the vehicle 1 is in the third communication state in which the active sate of communication is continuously maintained due to the noise signal, the control part 100 may cut off a power of all the controllers 110 in the vehicle 1.

The control part 100 may store information about at least one of a power cut-off history or a power reset history of the plurality of controllers 110 in the vehicle 1 in the database 120 of the vehicle 1. In this instance, the database 120 may be included in an integrated central control unit (ICU), without being limited thereto.

The control part 100 may transmit the information about at least one of the power cut-off history or the power reset history of the plurality of controllers 110 in the vehicle 1 to a cloud center.

Here, the database 120 may be implemented with at least one of a non-volatile memory such as cache, read only memory (ROM), programmable read only memory (PROM), erasable programmable read only memory (EPROM) and flash memory, a volatile memory such as random access memory (RAM) and storage medium such as hard disk drive (HDD) and compact disc read only memory (CD-ROM), without being limited thereto. The database 120 may be a memory implemented as a chip separate from a processor in relation to a control part (not shown) or may be implemented as a single chip with the processor.

When inactivation of communication of a conventional controller 110 continuously occurs, a charging capacity of a battery is significantly consumed up to 8% based on 40 minutes.

Also, because the controller 110 may be blocked only when a condition that a state of charge (SOC) of the battery is less than 40% is satisfied, when a permanent faulty controller 110 is mounted, forced load shedding may be performed only when the battery is consumed up to 68%.

However, according to an embodiment, because the vehicle 1 may cut off a load of a controller 110 in which an error occurs within 10 minutes, only approximately 2% of battery capacity may be consumed even when a communication inactivation occurs. Accordingly, a battery discharge may be effectively prevented. Also, battery consumption may be reduced by more than 75%, and thus a durability of the battery may be improved.

As described above, according to an embodiment, the vehicle 1 may store and manage the power cut-off history or the power reset history of each of the plurality of controllers 110 in the database 120 or the ROM.

Also, the vehicle 1 may accurately identify a controller 110 causing the battery discharge by transmitting the power cut-off history or the power reset history of each of the plurality of controllers 110 to the cloud center, and thereby may secure a safety of the entire power of the vehicle 1.

Hereinafter, when an RKE controller 110 is included in the plurality of controllers 110, a method that enables a user to temporarily use an RKE function by applying an RKE redundancy technology is described.

According to another embodiment, the vehicle 1 may further include the RKE module 141. The RKE module 141 may control the antenna 140 so that the antenna 140 is connected to one of the ICU and the RKE controller 142 via a relay.

Here, the RKE module 141 may be implemented in the ICU of the vehicle 1.

In this instance, the antenna 140 may be commonly used to control the vehicle 1 as a whole as well as an RKE-related control.

When the user uses an RKE function while the power of the vehicle 1 is cut off, the control part 100 may receive a radio frequency (RF) signal and switch a relay of the antenna 140 for controlling locking/unlocking of the door 150.

For instance, when the user attempts to unlock the door 150 using the RKE function, the control part 100 may switch the relay of the antenna 140 so that the ICU and the antenna 140 may be connected to each other.

In this instance, because the relay of the antenna 140 may not be controlled after the vehicle 1 is discharged, the control part 100 may control the antenna 140 to be connected to the ICU before the power of the controller 110 is cut off.

When the antenna 140 is connected to the ICU, the control part 100 may control the RKE controller 142 to unlock the door 150 using emergency power of the ICU.

Although it has been described that the RKE module 141 is implemented in the ICU of the vehicle 1 in the embodiment, the RKE module 141 is not limited thereto.

As described above, when the vehicle 1 is discharged, when the load of the controller 110 is cut off, or when a power of a low voltage battery of a hybrid electric vehicle (HEV) is cut off, inconvenience of opening a vehicle door with a manual key may be overcome by applying the RKE redundancy technology linked with a technology of automatically cutting off the controller in error.

Further, the vehicle 1 may provide the user with convenience of opening the vehicle door at least one time using RKE.

The control part 100 may be implemented with a memory (not shown) storing an algorithm for controlling operations of constituent components of the vehicle 1 or data of a program executing the algorithm, and a processor (not shown) performing the aforementioned operations using the data stored in the memory. In this instance, the memory and the processor may be implemented as separate chips or as a single chip.

FIG. 3 is a diagram illustrating priority training data of a vehicle according to an embodiment.

Referring to FIG. 3, when an integrated body control unit (IBU) 112 and a head unit (HU) 111 among the plurality of controllers 110 are in an active state, the control part 100 may reset or cut off a power of the IBU 112 with lower priority first, based on priorities shown in FIG. 3.

Despite the reset or cut-off of the power of the IBU 112, when a network in the vehicle 1 is in the active state, the control part 100 may reset or cut off a power of the HU 111 with a highest priority, based on the priorities shown in FIG. 3.

Figure 4:
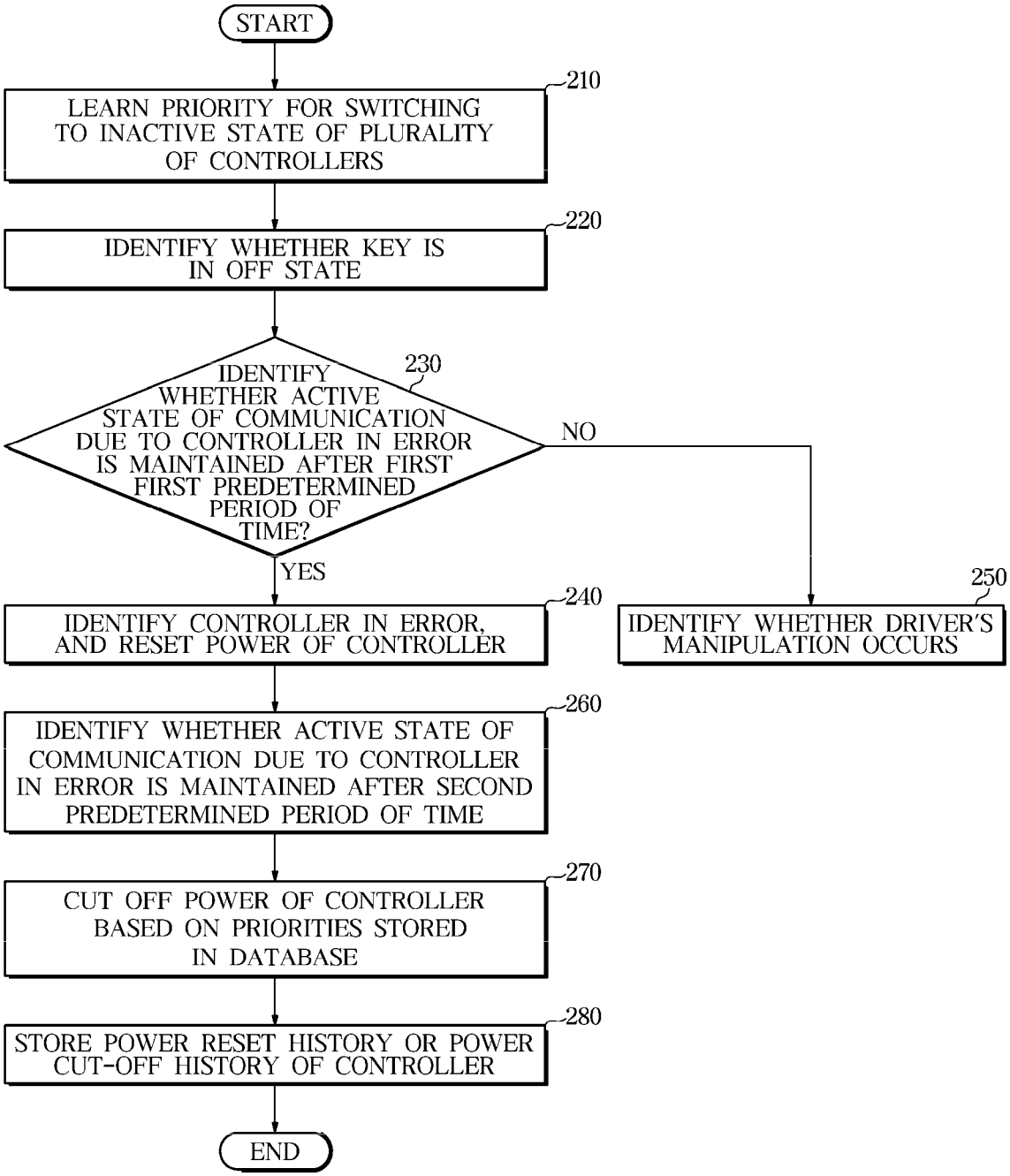
FIG. 4 is a flowchart illustrating a control method for cutting off power of a controller of a vehicle according to an embodiment.

FIG. 4 is a flowchart illustrating a control method for cutting off power of a controller of a vehicle according to an embodiment.

Referring to FIG. 4, the vehicle 1 may learn priorities for switching to an inactive state of the plurality of controllers 110 at 210. The vehicle 1 may identify whether a key is in 'off' state at 220. When it is identified that the key is in 'off' state, the vehicle 1 may identify whether a network in the vehicle 1 is continuously in a first communication state due to a controller 110 in error, after a first predetermined period of time at 230. When the first communication state is maintained, the vehicle 1 may identify a controller 110 corresponding to the first communication state, and reset a power of the controller 110 corresponding to the first communication state at 240.

More specifically, the vehicle 1 may confirm a power reset history or a power cut-off history of each of the plurality of controllers 110 in order to identify the controller 110 corresponding to the first communication state. Here, the power reset history or a power cut-off history of each of the plurality of controllers 110 are stored in the database 120.

The vehicle 1 may identify whether a driver's manipulation occurs while the first communication state is maintained at 250. When it is identified that the driver's manipulation occurs, the vehicle 1 may recognize that the network is activated normally, and may not reset the power of the controller 110. Here, the driver's manipulation may include a use of an RKE function, a wireless control (e.g. a Blue link, an audio, video, navigation and telematics (AVNT)), and a hazard lamp control, without being limited thereto. When it is identified that the network is in the first communication state and activated normally, the vehicle 1 may initialize a timer.

The vehicle 1 may identify whether the first communication state due to the controller 110 in error is maintained after a second predetermined period of time at 260.

When it is identified that the network in the vehicle 1 is still in the first communication state due to the controller 110 in error even after the second predetermined period of time after the power of the controller 110 is reset, the vehicle 1 may cut off the power of the controller 110 based on priorities of switching to an inactive state of the controller 110. Here, the priorities are stored in the database 120 at 270.

For example, the vehicle 1 may cut off a power of a controller 110 with a highest priority based on the priorities stored in the database 120, and also cut off a power of an upper controller 110 of a controller where an error currently occurs.

Although it has been described above that the power of the controller 110 is cut off after resetting one time, the number of power resets may be variously set.

The vehicle 1 may store information about the power reset history or the power cut-off history of each of the plurality of controllers 110 at 280.

More specifically, the vehicle 1 may store the information about the power reset history or the power cut-off history of each of the plurality of controllers 110 in the database 120 or ROM in log format.

Also, the vehicle 1 may transmit the information about at least one of the power reset history or the power cut-off history of each of the plurality of controllers 110 to a telemetric center, store the information in a cloud form, and thereby may analyze a degree of occurrence of the active state of each of the plurality of controllers 110 after the key is in off state.

Accordingly, a controller 110 causing an activation of communication of the network in the vehicle 1 may be identified more accurately, and a discharge of the vehicle 1 may be overcome in a short time.

Figure 5:
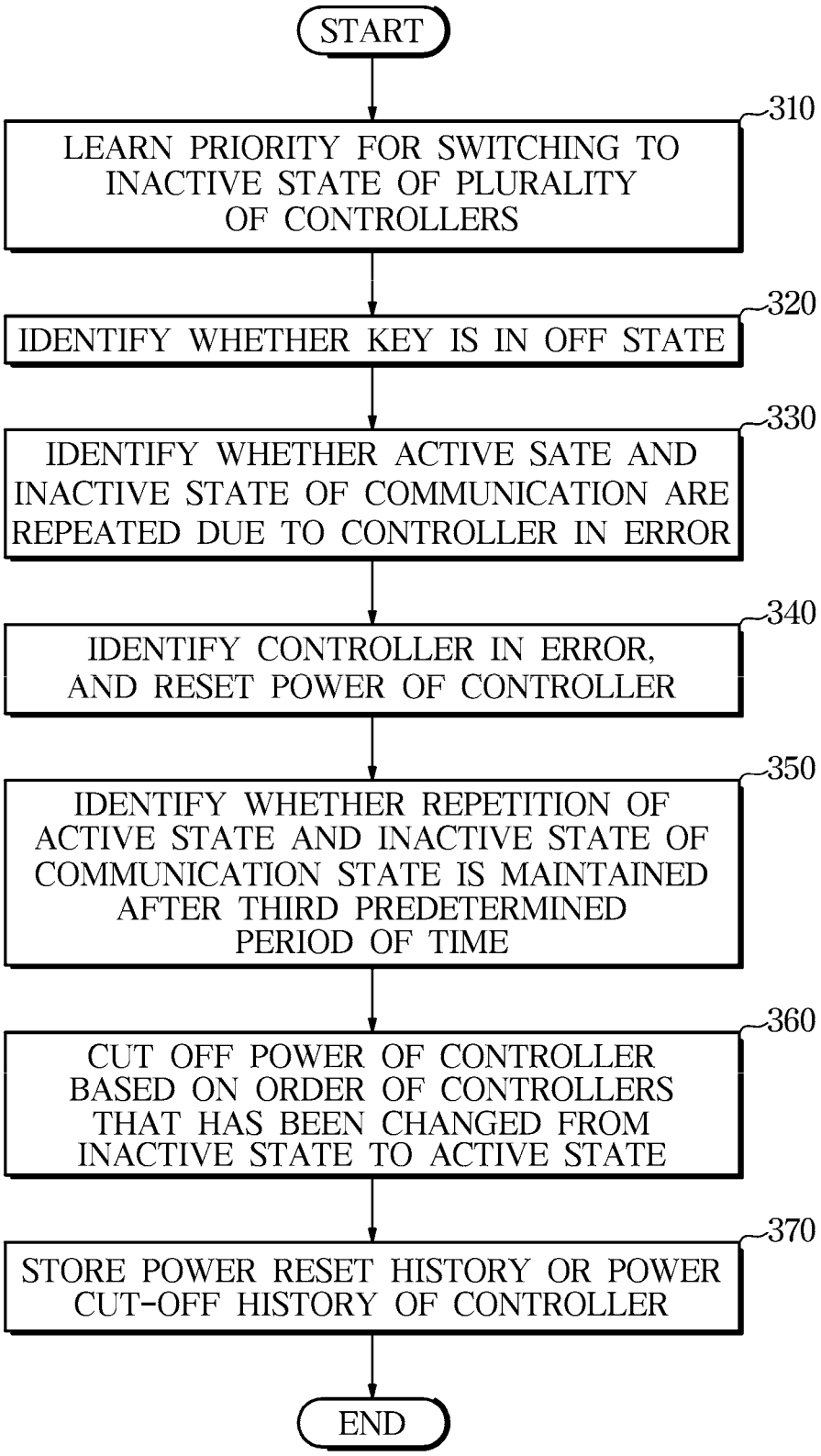
FIG. 5 is a flowchart illustrating a control method for cutting off power of a controller of a vehicle according to another embodiment.

FIG. 5 is a flowchart illustrating a control method for cutting off power of a controller of a vehicle according to another embodiment.

Referring to FIG. 5, the vehicle 1 may learn priorities for switching to an inactive state of the plurality of controllers 110 at 310. The vehicle 1 may identify whether a key is in off state at 320. The vehicle 1 may identify whether a second communication state in which an active sate and the inactive state of communication are repeated due to a controller 110 in error occurs, after the key is turned off at 330.

When the second communication state is maintained, the vehicle 1 may identify a controller 110 corresponding to the second communication state. More specifically, the vehicle 1 may confirm a power reset history or a power cut-off history of each of the plurality of controllers 110 stored in the database 120, in order to identify the controller 110 corresponding to the second communication state.

In this instance, the vehicle 1 may identify whether a driver's manipulation occurs. When it is identified that the driver's manipulation occurs, the vehicle 1 may recognize that a network is activated normally.

When it is not identified that the driver's manipulation occurs, the vehicle 1 may reset a power of the controller 110 in error at 340.

After resetting the power of the controller 110 in error, the vehicle 1 may identify whether the second communication state is maintained after a third predetermined period of time at 350.

When the second communication state is maintained, the vehicle 1 may identify an order of controllers 110 that has been changed from the inactive state to the active state for a predetermined period of time T. The vehicle 1 may identify a controller 110 of an earliest order of changing from the inactive state to the active state, and cut off a power of the controller 110 at 360.

For example, the vehicle 1 may identify a controller 110 which is in the active state among the plurality of controllers 110 by distinguishing activation and inactivation by referring to an inactivation attribute value of the controller 110 included in an NM message.

In a domain where the NM message is not applied, the vehicle 1 may identify an active state of a controller 110 based on a presence or absence of a transmission/reception signal. Specifically, the vehicle 1 may simultaneously monitor domains that use the NM message, and identify a controller 110 in which all attributes of the NM message are changed first from the inactive state to the active state.

The vehicle 1 may store information about a power reset history or a power cut-off history of each of the plurality of controllers 110 at 370.

Figure 6:
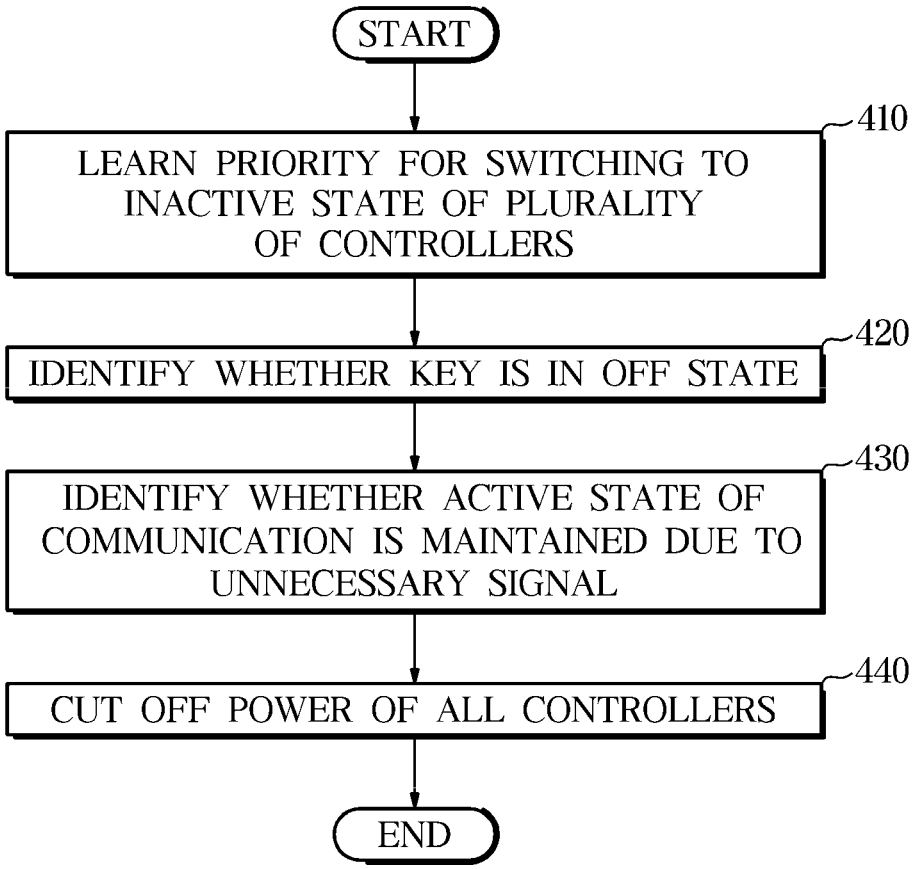
FIG. 6 is a flowchart illustrating a control method for cutting off power of a controller of a vehicle according to still another embodiment.

FIG. 6 is a flowchart illustrating a control method for cutting off power of a controller of a vehicle according to still another embodiment.

Referring to FIG. 6, the vehicle 1 may learn priorities for switching to an inactive state of the plurality of controllers 110 at 410. The vehicle 1 may identify whether a key is in off state at 420. The vehicle 1 may identify whether a third communication state of the controller 110 is maintained because a noise signal is received at 430. In this instance, the vehicle 1 may identify whether a driver's manipulation occurs. When it is identified that the driver's manipulation occurs, the vehicle 1 may identify that a network is activated normally. When it is not identified that the driver's manipulation occurs, the vehicle 1 may cut off a power of all the controllers 110 at 440.

Figure 7:
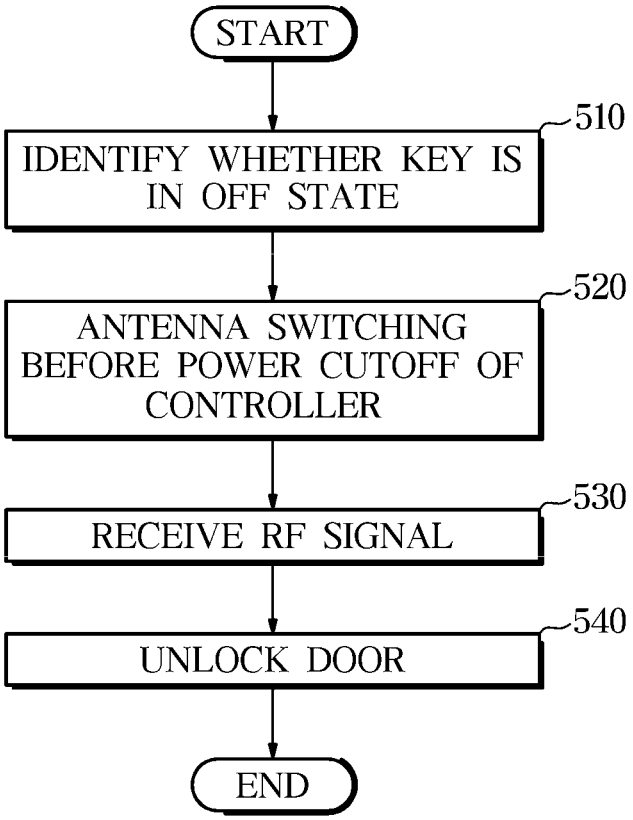
FIG. 7 is a flowchart illustrating a control method for automatically opening and closing a vehicle door before cutting off power of a controller of a vehicle according to yet another embodiment.

FIG. 7 is a flowchart illustrating a control method for automatically opening and closing a vehicle door before cutting off power of a controller of a vehicle according to yet another embodiment.

The vehicle 1 may identify whether a key is in off state at 510. When the vehicle 1 is discharged, the load of the controller 110 is cut off, or a power of a low voltage battery of a HEV is cut off, the vehicle 1 may control the antenna 140 to switch a relay of the antenna 140 so that the antenna 140 is connected to an ICU at 520. When a user attempts to unlock the door 150 using an RKE function, the vehicle 1 may receive a RF signal at 530.

In this instance, the RKE module 141 applies a Super Cab element to a power supply part to perform charging while the vehicle 1 is being used, and when a power of the vehicle 1 is cut off, the RKE module 141 may use the Super Cab as a temporary power.

The vehicle 1 may control the RKE controller 142 to unlock the door 150 using the temporary power in the ICU at 540.

Because a power of the RKE module 141 is required to be maintained, the vehicle 1 may set a temporary power usage for unlocking the door 150, considering a current Super Cab and a usage to maintain the power of the RKE module 141.

Also, the RKE module 141 may monitor a software version of the RKE controller 142. The RKE module 141 may copy the monitored data as it is and store the data in the RKE module 141. In addition, when data of the RKE controller 142 is updated, the RKE module 141 may periodically store the updated data.

As is apparent from the above, according to the embodiments of the disclosure, the vehicle and the control method thereof can, when a permanent faulty controller is mounted, prevent battery discharge effectively by cutting off a load of the faulty controller in a short time, and improve a durability of a battery by reducing battery consumption and preventing battery discharge.

The vehicle and the control method thereof can store and manage a power reset history or power cut-off history of the controller, accurately identify a controller causing the battery discharge, and secure a safety of total power of the vehicle.

The vehicle and the control method thereof can overcome inconvenience of opening a vehicle door with a manual key when the vehicle is discharged or the load of the controller is cut off, by applying an RKE redundancy technology linked with a technology of automatically blocking the faulty controller.

Embodiments can thus be implemented through computer readable code/instructions in/on a medium, e.g., a computer readable medium, to control at least one processing element to implement any above described exemplary embodiment. The medium can correspond to any medium/media permitting the storing and/or transmission of the computer readable code.

The computer-readable code can be recorded on a medium or transmitted through the Internet. The medium may include read only memory (ROM), random access memory (RAM), magnetic tapes, magnetic disks, flash memories, and optical recording medium.

Although embodiments have been described for illustrative purposes, those skilled in the art will appreciate that various modifications, additions and substitutions are possible, without departing from the scope and spirit of the disclosure. Therefore, embodiments have not been described for limiting purposes.

The invention claimed is:

1. A vehicle, comprising:

a plurality of controllers;

a database in which priorities for switching to inactivation of the plurality of controllers are stored; and a main controller configured to:

identify whether a key of the vehicle is in off state;

when the key of the vehicle is identified to be in off state, identify a communication state of the vehicle;

when at least one communication state is identified among a first communication state, a second communication state and a third communication state, select a controller corresponding to the identified communication state from the plurality of controllers based on the identified communication state and the priorities stored in the database, the first communication state in which an active sate of communication being maintained due to a controller in error, the second communication state in which the active state and an inactive state of communication being repeated due to the controller in error, the third communication state in which the active state of communication being maintained due to a noise signal; and reset or cut off a power of the controller.

2. The vehicle of claim 1, wherein, when the first communication state continues after a first predetermined period of time after the key of the vehicle is turned off, the main controller is configured to identify a controller corresponding to the first communication state, and reset a power of the identified controller.

3. The vehicle of claim 2, wherein the main controller is configured to repeatedly reset the power of the controller a preset number of times, when the first communication state continues after the power of the controller is reset.

4. The vehicle of claim 1, wherein, when the first communication state continues after a second predetermined period of time after the key of the vehicle is turned off, the main controller is configured to cut off the power of the controller based on the priorities stored in the database.

5. The vehicle of claim 1, wherein, when the communication state is identified as the second communication state, the main controller is configured to identify a controller corresponding to the second communication state and reset a power of the controller based on a network management (NM) message.

6. The vehicle of claim 5, wherein, when the second communication state continues after a third predetermined period of time after the key of the vehicle is turned off, the controller is configured to identify a controller that is changed first from the inactive state to the active state, among the plurality of controllers based on the NM message, and cut off a power of the identified controller.

7. The vehicle of claim 1, wherein the main controller is configured to cut off an entire power of the plurality of controllers, when the communication state is identified as the third communication state.

8. The vehicle of claim 1, wherein the main controller is configured to store information about at least one of a power reset history or a power cut-off history of the plurality of controllers in the database, and transmit the stored information to a cloud center.

9. The vehicle of claim 1, further comprising:

an antenna; and a remote keyless entry (RKE) module including an RKE controller.

10. The vehicle of claim 9, wherein, when a door opening and closing signal using RKE is received from a user, the controller is configured to switch a relay of the antenna to automatically open and close a door.

11. The vehicle of claim 9, wherein the main controller is configured to periodically update the RKE controller based on an update of the RKE controller.

12. A control method of a vehicle, the control method comprising:

identifying whether a key of the vehicle is in off state;

when the key of the vehicle is identified to be in off state, identifying a communication state of the vehicle;

when at least one communication state is identified among a first communication state, a second communication state and a third communication state, selecting a controller corresponding to the identified communication state based on the identified communication state and priorities stored in a database, the first communication state in which an active sate of communication being maintained due to a controller in error, the second communication state in which the active sate and an inactive state of communication being repeated due to the controller in error, the third communication state in which the active state of communication being maintained due to a noise signal; and resetting or cutting off a power of the controller.

13. The control method of claim 12, comprising:

when the first communication state continues after a first predetermined period of time after the key of the vehicle is turned off, identifying a controller corresponding to the first communication state, and resetting a power of the identified controller.

14. The control method of claim 13, comprising:

repeatedly resetting the power of the controller a preset number of times, when the first communication state continues after the power of the controller is reset.

15. The control method of claim 12, comprising:

when the first communication state continues after a second predetermined period of time after the key of the vehicle is turned off, cutting off the power of the controller based on the priorities stored in the database.

16. The control method of claim 12, comprising:

when the communication state is identified as the second communication state, identifying a controller corresponding to the second communication state and resetting a power of the controller based on an NM message.

17. The control method of claim 16, comprising:

when the second communication state continues after a third predetermined period of time after the key of the vehicle is turned off, identifying a controller that is changed first from the inactive state to the active state among a plurality of controllers, based on the NM message, and cutting off a power of the identified controller.

18. The control method of claim 12, comprising:

cutting off an entire power of a plurality of controllers, when the communication state is identified as the third communication state.

19. The control method of claim 12, comprising:

storing information about at least one of a power reset history or a power cut-off history of a plurality of controllers in the database, and transmitting the stored information to a cloud center.

20. The control method of claim 12, comprising:

when a door opening and closing signal using RKE is received from a user, switching a relay of an antenna to automatically open and close a door.

* * * * *